US008851228B2

(12) United States Patent
He et al.

(10) Patent No.: US 8,851,228 B2
(45) Date of Patent: Oct. 7, 2014

(54) SPEAKER DIAPHRAGM AND ITS MANUFACTURING METHOD

(71) Applicant: Feng Chia University, Taichung (TW)

(72) Inventors: Ju-Liang He, Taichung (TW); Po-Yu Chen, Taichung (TW)

(73) Assignee: Feng Chia University, Taichung (TW)

( * ) Notice: Subject to any disclaimer, the term of this patent is extended or adjusted under 35 U.S.C. 154(b) by 0 days.

(21) Appl. No.: 13/939,933

(22) Filed: Jul. 11, 2013

(65) Prior Publication Data

US 2014/0054104 A1 Feb. 27, 2014

(30) Foreign Application Priority Data

Aug. 23, 2012 (TW) ..... 101130574 A

(51) Int. Cl.

*H04R 7/10* (2006.01)
*H04R 31/00* (2006.01)
*H04R 7/12* (2006.01)

(52) U.S. Cl.

CPC ..... *H04R 31/003* (2013.01); *H04R 2307/023* (2013.01); *H04R 7/125* (2013.01)
USPC ..... 181/167; 381/426

(58) Field of Classification Search

USPC ..... 181/167, 168, 169, 170; 381/426, 427, 381/428

See application file for complete search history.

(56) References Cited

U.S. PATENT DOCUMENTS

| | | | | | |
|---|---|---|---|---|---|
| 4,129,195 | A * | 12/1978 | Ishii et al. | ..... | 181/167 |
| 4,772,513 | A * | 9/1988 | Sakamoto et al. | ..... | 428/408 |
| 5,805,726 | A | 9/1998 | Yang et al. | | |
| 7,483,545 | B2 * | 1/2009 | Nagaoka | ..... | 381/423 |
| 7,508,120 | B2 * | 3/2009 | Akiyama et al. | ..... | 310/358 |
| 2011/0240401 | A1 * | 10/2011 | Suzuki et al. | ..... | 181/157 |

FOREIGN PATENT DOCUMENTS

| | | | | | |
|---|---|---|---|---|---|
| CN | 101288336 | A | | 10/2008 | |
| JP | 59169298 | A | * | 9/1984 | ..... H04R 7/02 |
| JP | 2001285989 | A | * | 10/2001 | ..... H04R 7/02 |
| TW | 201023660 | A | | 6/2010 | |
| TW | 201130329 | A | | 9/2011 | |

* cited by examiner

*Primary Examiner* — Jeremy Luks
(74) *Attorney, Agent, or Firm* — Rabin & Berdo, P.C.

(57) ABSTRACT

A speaker diaphragm structure includes a speaker diaphragm and a coating formed on the speaker diaphragm and is composed of at least one dense layer and relatively porous layer alternately arranged with respect to the at least one dense layer.

6 Claims, 5 Drawing Sheets

SPEAKER DIAPHRAGM AND ITS MANUFACTURING METHOD

CROSS-REFERENCE TO RELATED APPLICATION

This application claims priority from application No. 101130574, filed on Aug. 23, 2012 in the Taiwan Intellectual Property Office.

FIELD OF THE INVENTION

The invention is related to a loudspeaker diaphragm, and more particularly, to a loudspeaker diaphragm with a composite structure comprising dense and porous layers alternately stacked on top of one another; this arrangement allows the loudspeaker diaphragm to be mechanically stiff as well as to have damping characteristic so as to improve sound quality.

BACKGROUND OF THE INVENTION

A full set of audio system comprises an audio source, an amplifier, and a loudspeaker. The audio source provides electrical signals to amplifier; then, the amplified electrical signals are delivered to the loudspeaker, which would then transform electrical energy to acoustic energy, i.e. the sound. Speakers are generally categorized into electrostatic loudspeaker (EFL), moving coil loudspeaker, and piezo loudspeaker. The most popular loudspeaker is the moving coil loudspeaker because of its simple structure, low cost, and better sound quality. A typical full set of moving coil loudspeakers is composed of a diaphragm, a permanent magnet, a moving coil, and a casing; the diaphragm is mainly responsible for creating sound in which sound quality significantly influenced by the diaphragm material. In other words, sound quality primarily depends on the accurate vibration of the diaphragm, and a ideal diaphragm can vibrate without distortion to generate sound through a wide range of vibration frequencies.

A satisfactory speaker should have at least the following three characteristics:

1. Speaker diaphragm should have a high Young's modulus (modulus of elasticity) to response faithfully by the moving coil.
2. The speaker diaphragm should have a high mechanical damping capacity (internal loss), so that the irregular mode of vibration can be regulated.
3. Speaker diaphragm material should be light weight for immediate responding with the moving coil.

To accomplish the above-mentioned characteristics, various materials such as paper, metal, ceramics, and polymeric materials have been developed for use in making speaker diaphragm. A single speaker diaphragm material cannot fulfill the aforementioned characteristics to reach ultimate sound quality. Therefore, composite materials were considered for use. The typical example is using carbon fibers (with high Young's modulus) to strengthen the polypropylene resin for speaker diaphragm in practical industrial service. This allows the speaker diaphragm to have an increased elastic modulus and damping capacity at the same time; however, it is difficult to trade-off. Among the literatures available to the public, there are a variety of methods for improving sound quality from different aspects. One example in a Taiwanese patent (No. 201023660) disclosed speaker improvement concerning the decrease in the undesired vibration of the coil. The speaker comprises a frame and a vibration module connected to the frame and is composed of an edge and a diaphragm. The diaphragm is connected to the peripheral edge of the frame so that when the coil vibrates and starts making sounds, the edge helps stabilizing.

An U.S. Pat. No. 5,805,726A1 introduced a piezo loudspeaker that focuses on the improvement in vibration by using a damping force to acquire better sound quality; the speaker is compact in size, has high fidelity, and is free from interference of EM wave. With all the advantages, such a speaker should be considerably popular in the market. However, because of the difficult manufacturing process and the high manufacturing cost, manufacturers are having second thoughts in adopting this technology. Furthermore, because this speaker adopts a diaphragm driven with a single piezoelectric actuator, it causes a deficiency of sound pressure. As a result, the speaker diaphragm is inflexible, and the application is thus greatly limited.

Following the advancement of modern technology, innovations to materials engineering have led great evolution for speaker diaphragm. These improvements for speaker diaphragm can be dated back to 1998 in the U.S. Pat. No. 4,772,513, where demonstration was done to the improvement of sound quality by using an additional amorphous carbon material coated on the metallic diaphragm or the composite diaphragm to have a high Young's modulus and light weight. Another Taiwanese Pat. 201130329A1 disclosed a new metal titanium diaphragm with a diamond-like coating, which the sound quality is greatly improved; however, metal titanium diaphragm is only viable for operation in high sound frequency. On the other hand, carbon nanotube is a newly discovered nano material and was adapted as an additional coating supported by a polymeric membrane to form a speaker diaphragm in a Chinese Patent CN101288336A. However, the adhesion of the overall carbon nanotube layer can be poor, not to mention possible difficulty in homogeneous dispersion of the carbon nanotube.

SUMMARY OF THE INVENTION

The primary objective of the present invention is to provide an improved speaker diaphragm having a high Young's modulus and a high damping capacity.

To accomplish the aforementioned objective, the speaker diaphragm of the preferred embodiment of the present invention includes the following:

a speaker diaphragm; and a coating on the speaker diaphragm composed of at least one dense layer and at least one relatively porous layer alternately stacked with respect to the dense layer. The dense layer is responsible for providing stiffness and the porous layer is responsible for providing damping capacity to the speaker diaphragm.

In a preferred embodiment of the present invention, the coating is applied on the preexisted speaker diaphragm via vacuum coating, and the vacuum coating is applied by arc ion plating technique.

Furthermore, the relatively porous layer is formed via feeding the processing gas (acetylene gas in the case of carbon coating) at a high flow rate so as to develop the porous layer.

In a preferred embodiment, the coating is a carbon coating.

Another objective of the preferred embodiment of the present invention is to provide a manufacturing method for a speaker diaphragm having a high Young's modulus and a high damping capacity.

To accomplish the above-mentioned objective, the method of the preferred embodiment of the present invention includes the steps of:

providing a speaker diaphragm; and forming a coating on the speaker diaphragm, the coating being composed of at least one dense layer and at least one relatively porous layer alternately arranged with respect to the at least one dense layer.

In the preferred embodiment of the present invention, the coating is applied on the speaker diaphragm via vacuum coating.

In the preferred embodiment of the present invention, the vacuum coating is an arc ion plating technique.

Furthermore, the relatively porous layer is formed via feeding the processing gas at a high flow rate so as to develop porous layer.

In the preferred embodiment, the coating is a carbon coating.

In accordance with the method described above, the speaker diaphragm constructed in accordance with the preferred embodiments of the present invention satisfies the requirements of a high Young's modulus and a high damping capacity. With all the characteristics, the speaker diaphragm constructed in accordance with the present invention can generate high-quality sound.

With respect to the aforementioned structure and the method of the present invention, the speaker diaphragm constructed uses, for example, light-weight carbon as the coating ingredient to allow it to fully satisfy the three requirements of an ideal speaker diaphragm. The speaker diaphragm of the present invention can be made of any suitable material. Then, a multilayer coating with dense layer corresponding to high Young's modulus and porous layer corresponding to high damping capacity is successively applied on the surface of the speaker diaphragm via vacuum coating. This coating may contain any suitable material intrinsically high in Young's modulus and capable of growing fast enough to develop porous structure through the manipulation of coating process parameters, processing gas in particular.

With the concept of this invention, any coating process parameters viable for any particular coating technique, such as working pressure and evaporation rate of raw material, etc. can also be manipulated so as to develop an alternating dense/porous multilayer coating allowing the speaker diaphragm to achieve the characteristics of high stiffness and high damping capacity as compared to a conventional speaker diaphragm.

DETAILED DESCRIPTION OF THE INVENTION

Other features and advantages of the invention will become apparent after the introduction of the following detailed description of the preferred embodiments with reference to the accompanying drawings.

Figure 1:
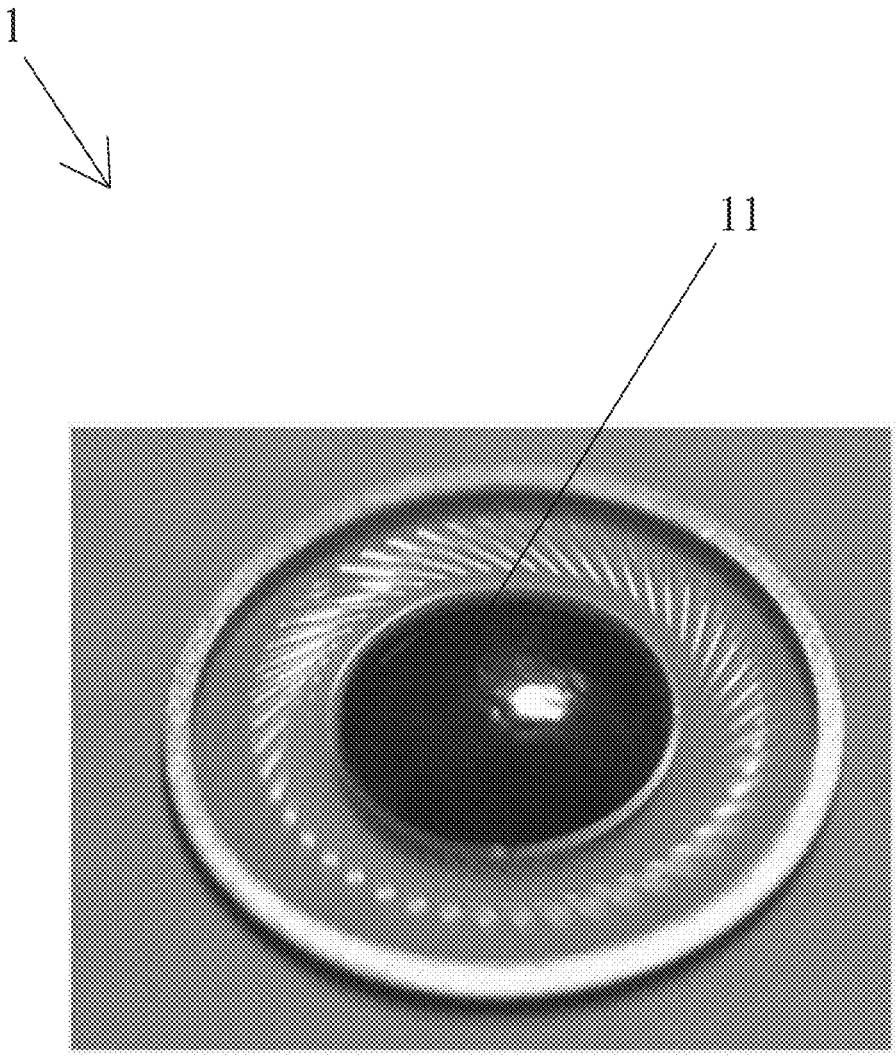
FIG. 1 shows a perspective view of the speaker diaphragm of the preferred embodiment of the present invention.
Figure 2:
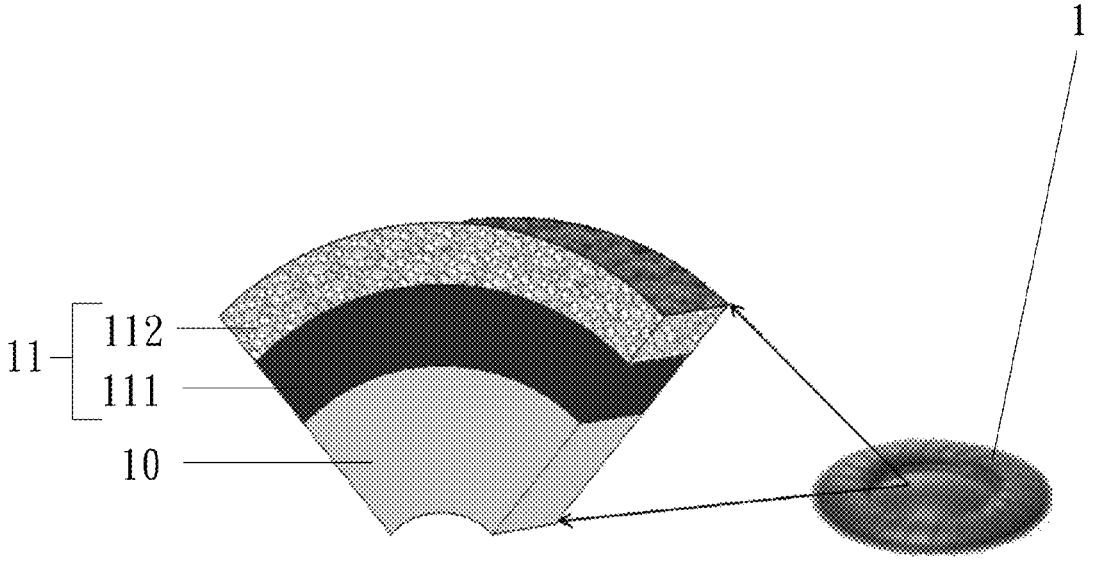
FIG. 2 shows a schematic view of the application of the speaker diaphragm with a multilayer coating thereon.

With reference to FIGS. 1 and 2, a method for making a speaker diaphragm constructed in accordance with the preferred embodiment of the present invention includes the steps of

110: providing a speaker diaphragm 10; and

120: forming a coating 11 on the speaker diaphragm 10; the coating 11 is composed of a dense layer 111 and a relatively porous layer 112 alternately arranged with respect to the dense layer 111.

In the speaker-diaphragm-providing step 110, the speaker diaphragm 10 is constrained on the diaphragm frame 1. In the coating step 120, the coating 11 is deposited on the speaker diaphragm 10 via vacuum coating technique. The vacuum coating method is an arc ion plating to produce carbon coating.

When in application, the speaker frame 1 with diaphragm 10 is placed in an arc ion plating system (AIP), or so called cathodic arc deposition plasma system (CAD). A gas containing carbon, such as acetylene, is admitted. When the gas passes by the metal target, the arc generates over the target surface activates acetylene to become considerably ionized, which consequently is deposited as a carbon-containing coating 11 on the substrate, the speaker diaphragm 10. With the adjustment of the coating time, work pressure, and gas flow rate, a dense and porous structure with a predetermined thicknesses obtained. Therefore, a speaker diaphragm having a dense layer 111 and a relatively porous layer 112 has a high Young's modulus and a damping capacity.

The coating conditions are as shown in Table 1. There are three stages to complete a coat run: acetylene bombardment for substrate cleaning (also for the increased coating adhesion), formation of dense layer 111, and formation of relatively porous layer 112. The relatively porous layer 112 primarily employs a high processing gas flow rate to allow the film formation rapidly with a porous structure, which is attributed to the rapid condensation of the ionized processing gas.

TABLE 1

Representative coating parameters required for using arc ion plating

| Coating parameter | | Value |
|---|---|---|
| Acetylene bombardment | Acetylene flow rate (sccm) | 100 |
| | Work pressure (mTorr) | 1 |
| | Bombardment time (min) | 3 |
| | Substrate bias (−v) | 200 |
| Dense layer plating (having high rigidity) | Target | 99.5% Titanium |
| | Acetylene flow rate (sccm) | 300 |
| | Work pressure (mTorr) | 10 |
| | Deposition time (min) | 4 |
| | Substrate bias (−v) | 100 |
| | Target current (A) | 70 |
| | Target voltage (V) | 20 |
| Relatively porous layer plating (with high damping capacity) | Target | 99.5% Ti |
| | Acetylene flow (sccm) | 300 and quickly increases up to 500 |
| | Work pressure (mTorr) | 10~30 |
| | Deposition time (min) | 2 |
| | Substrate bias (−v) | 100 |
| | Target current (A) | 70 |
| | Target voltage (V) | 20 |

Figure 3:
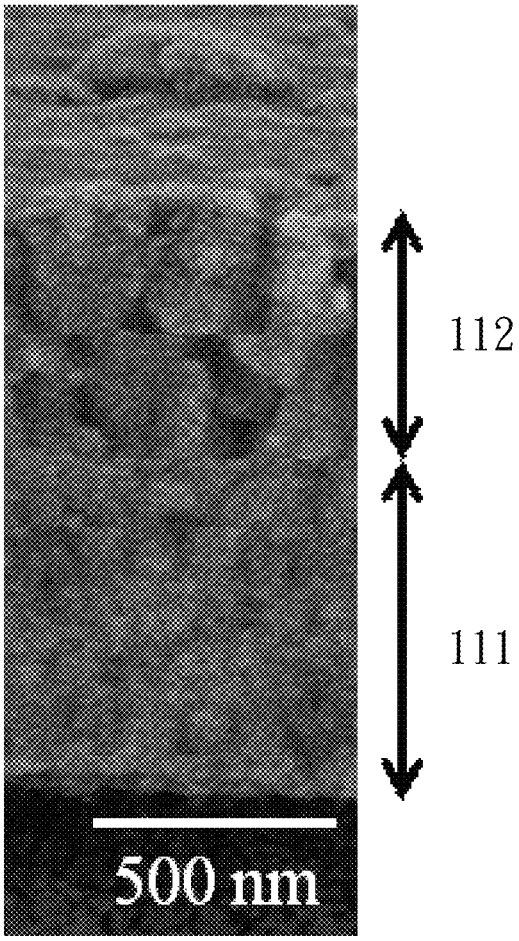
FIG. 3 shows a cross sectional view of the embodiment of the present invention; the relatively porous layer and the dense layer are shown in this figure.

With reference to FIGS. 1, 2, and 3, the speaker diaphragm constructed in accordance with the method of the present invention includes at least a speaker diaphragm 10 and a coating 11. The speaker diaphragm 10 may be, for example, a polymeric diaphragm. The coating 11 is composed of at least one dense layer 111 and at least one relatively porous layer 112 alternately arranged with respect to the dense layer 111. The coating 11 is coated on the speaker diaphragm 10 via vacuum coating that is deposited using arc ion plating and the coating 11 is a carbon coating.

The coating 11 is coated on the speaker diaphragm 10 via arc ion plating and is composed of a dense layer 111 with a high Young's modulus and a relatively porous layer 112 with a high damping capacity so as to allow the speaker diaphragm 10 to perform the improved sound quality. The cross sectional view of the obtained multilayer is shown in FIG. 3. It is noted that the coating 11 initially grows into the dense layer 111. However, after the adjustment of the parameters in terms of increasing the processing gas flow rate, the relatively porous layer 112 is formed. Because of the existence of the relatively porous layer 112, the speaker diaphragm 10 presents a damping capacity.

Figure 4:
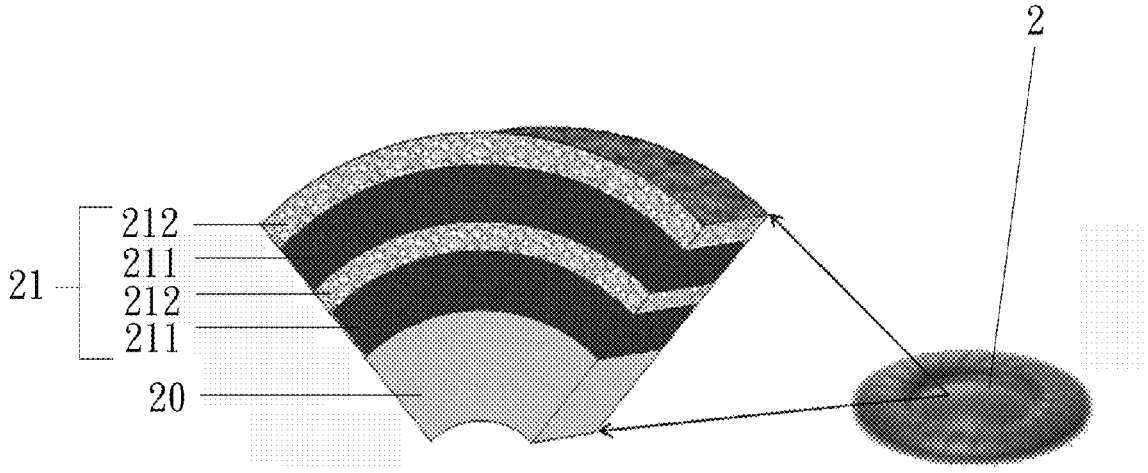
FIG. 4 shows a schematic view of the embodiment of the present invention, wherein the multilayer coating is provided on top of the speaker diaphragm.
Figure 5:
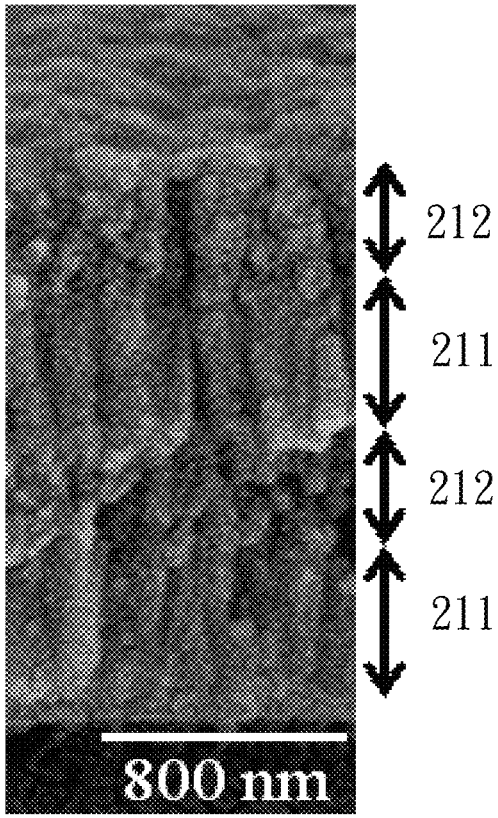
FIG. 5 shows a cross sectional view of the embodiment of the present invention, wherein the dense layers and the porous layers are alternately arranged with respect to one another.

With reference to FIGS. 4 and 5, a further embodiment of the present invention is shown, wherein a speaker membrane 2 has a speaker diaphragm 20 with a coating 21 coated thereon via arc ion plating and is composed of a number of dense layers 211 and a number of relatively porous layers 212 alternately arranged with respect to the relatively porous layers 211. Having the alternate arrangement of the relatively porous layers 212 and the dense layers 211, the speaker diaphragm 20 of the embodiment of the present invention has both a high Young's modulus and a high damping capacity.

With the concept of this invention, a relatively porous layer is formed on top of the dense layer so as to achieve the purpose of an alternate arrangement of the relatively porous layer and the dense layer and the goal of having both a high Young's modulus and a high damping capacity. Although the embodiment shown in the accompanying drawings indicates the dense layer 111 is formed before the dense layer 112, it is also possible to have the relatively porous layer 112 formed before the relatively porous layer 111.

With the adoption of vacuum deposition, the present invention has the following advantages:

1. High coating growth rate makes the formation of dense layers via vacuum deposition on the speaker diaphragm possible.
2. Excellent coating adherence prevents any peeling from the diaphragm membrane.
3. Relative low processing temperature when compared with other manufacture methods makes the application of coating, even that of a polymeric material, to expand From the above description, it is noted that the embodiments of the present invention has the following advantages:

Having the abovementioned coating parameters and the alternate arrangement of the dense layers and the relatively porous layers, the speaker diaphragm of the present invention has both a high Young's modulus and a high damping capacity, and is applicable to a variety of speaker size for improving sound quality.

While the invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

The following is claimed:

1. A speaker diaphragm structure comprising a speaker diaphragm; and a coating formed on the speaker diaphragm and composed of at least one dense layer and relatively porous layer alternately arranged with respect to the at least one dense layer;

wherein the coating is formed on the speaker diaphragm via vacuum deposition; and wherein the at least one relatively porous layer is formed via manipulating a processing gas flow rate so as to rapidly form the at least one relatively porous layer.

2. The speaker diaphragm as claimed in claim 1, wherein the vacuum deposition is carried out using arc ion plating.

3. The speaker diaphragm as claimed in claim 1, wherein the coating is a carbon coating.

4. A speaker diaphragm manufacturing method comprising the steps of providing a speaker diaphragm; and forming a coating on the speaker diaphragm;

the coating is composed of at least one dense layer and at least one relatively porous layer alternately arranged with respect to the at least one dense layer;

wherein the coating is formed on the speaker diaphragm via vacuum deposition; and wherein the at least one relatively porous layer is formed via manipulating a processing gas flow rate so as to rapidly form the at least one relatively porous layer.

5. The speaker diaphragm as claimed in claim 4, wherein the vacuum deposition is processed via arc ion plating.

6. The speaker diaphragm as claimed in claim 4, wherein the coating is a carbon coating.

* * * * *